US006912748B2

(12) United States Patent
VanSickle

(10) Patent No.: US 6,912,748 B2
(45) Date of Patent: Jul. 5, 2005

(54) SELF INFLATING PNEUMATIC SEAT CUSHION APPARATUS AND METHOD

(75) Inventor: James R. VanSickle, New Baltimore, MI (US)

(73) Assignee: L & P Property Management Company, Southgate, CA (US)

( * ) Notice: Subject to any disclaimer, the term of this patent is extended or adjusted under 35 U.S.C. 154(b) by 0 days.

(21) Appl. No.: 10/718,916

(22) Filed: Nov. 21, 2003

(65) Prior Publication Data

US 2004/0222684 A1 Nov. 11, 2004

Related U.S. Application Data

(60) Provisional application No. 60/428,392, filed on Nov. 22, 2002.

(51) Int. Cl.[7] ..... A47C 27/10; A47C 27/14; A47C 7/18

(52) U.S. Cl. ..... 5/654; 5/653; 5/655.3; 5/655.9

(58) Field of Search ..... 5/654, 653, 655.3, 5/655.9, 644, 706, 708, 709, 740, 420, 932, 953

(56) References Cited

U.S. PATENT DOCUMENTS

| | | | | | |
|---|---|---|---|---|---|
| 388,037 | A | * | 8/1888 | Hargin | 5/708 |
| 2,068,134 | A | * | 1/1937 | Houghton | 5/708 |
| 2,369,736 | A | * | 2/1945 | Hurt | 5/708 |
| 2,997,100 | A | | 8/1961 | Morris | 5/348 |
| 3,017,642 | A | | 1/1962 | Rosenberg et al. | 5/349 |
| 3,042,941 | A | * | 7/1962 | Marcus | 5/708 |
| 3,058,124 | A | | 10/1962 | Sturtevant | 5/345 |
| 3,068,494 | A | * | 12/1962 | Pinkwater | 5/708 |
| 3,112,502 | A | * | 12/1963 | Forsberg | 5/708 |
| 3,133,696 | A | * | 5/1964 | Mirando | 417/479 |
| 3,155,991 | A | * | 11/1964 | Dunham | 5/708 |
| 3,583,008 | A | * | 6/1971 | Edward | 5/655.3 |
| 3,616,471 | A | | 11/1971 | Braun | 5/348 |
| 4,644,597 | A | | 2/1987 | Walker | 5/449 |
| 4,788,729 | A | | 12/1988 | Walker | 5/449 |
| 4,908,895 | A | | 3/1990 | Walker | 255/453 |
| 4,930,174 | A | * | 6/1990 | Hunter | 5/708 |
| 5,033,133 | A | | 7/1991 | Nissen | 5/450 |
| 5,634,224 | A | | 6/1997 | Gates | 5/709 |
| 5,711,041 | A | * | 1/1998 | Chen | 5/708 |
| 5,898,963 | A | * | 5/1999 | Larson | 5/644 |
| 6,012,188 | A | | 1/2000 | Daniels et al. | 5/654 |
| 6,209,160 | B1 | * | 4/2001 | Harris | 5/708 |
| 6,219,868 | B1 | | 4/2001 | Wang | 5/709 |
| 6,240,584 | B1 | * | 6/2001 | Perez et al. | 5/713 |
| 6,269,505 | B1 | | 8/2001 | Wilkinson | 5/713 |
| 6,370,716 | B1 | | 4/2002 | Wilkinson | 5/715 |
| 6,418,579 | B2 | * | 7/2002 | Perez et al. | 5/713 |
| 6,568,013 | B2 | * | 5/2003 | Perez et al. | 5/710 |
| 6,611,981 | B1 | * | 9/2003 | Lin | 5/708 |
| 6,622,326 | B2 | * | 9/2003 | Richardson | 5/644 |
| 2001/0023512 | A1 | * | 9/2001 | Perez et al. | 5/713 |
| 2002/0133883 | A1 | * | 9/2002 | Perez et al. | 5/713 |
| 2004/0222684 | A1 | * | 11/2004 | VanSickle | 297/452.41 |

OTHER PUBLICATIONS

U.S. Appl. No. 09/586,076.

* cited by examiner

*Primary Examiner*—Robert G. Santos
(74) *Attorney, Agent, or Firm*—Husch & Eppenberger, LLC; Grant D. Kang

(57) ABSTRACT

A self inflating pneumatic seat cushion, especially for automobile seats, has foam filled bladders and bolsters. A pneumatic pumping chamber intakes air through an inlet and distributes air to the cushion bladders and bolsters through outlet tubes. The motion of a seat occupant against the pneumatic pumping chamber bladder operates to let air in through the inlet and distribute it through the outlet tubes. A collapsible seat has an exhaust valve for compressing the bladders in a stowed position. The exhaust valve may have an adjustable pressure release.

25 Claims, 6 Drawing Sheets

SELF INFLATING PNEUMATIC SEAT CUSHION APPARATUS AND METHOD

CROSS-REFERENCE TO RELATED APPLICATIONS

This application claims priority under 35 USC 119 (e) to U.S. Provisional Application No. 60/428,392, filed Nov. 22, 2002. The subject matter of the present invention is related to U.S. Application No. 09/586,076 filed on Jun. 2, 2000, now abandoned.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention is in the field of seat cushions, especially for automobile seats, and inflation of them.

2. Related Art

Pneumatic cushioning for seating is known. There is a constant need in the industry to ensure proper degrees of air pressure within pneumatic devices. Establishment and maintenance of proper pressure for a variety of pneumatic seat cushion deployments requires use of one of a variety of control modalities. Inflation for additional pressure is a particular concern. Inflation abilities are needed for uses such as cushion pressure adjustment over time by a single user, use cycles, use by different users, or seat frame adjustment, as for example in a foldable or "jump" seat. It is known to use resilient foam materials and controllable intake and exhaust valves, including check or stop valves, for controlling cushion pressure, see, U.S. patent application Ser. No. 09/586,076, incorporated in its entirety by reference herein. Expansion of resilient foam for inflation, as for example inflation after a folding jump seat has been unfolded for use, is adequate to inflate seat cushions to a useable degree of pressure and consequent firmness. However it is less than optimal in terms of increasing pressure for user desired selectability, or increasing pressure for variations in use, such as rough roads and differing passenger size. There is a need in the industry for additional inflation means together with pressure and firmness adjusting modalities.

SUMMARY OF THE INVENTION

The present invention is a pneumatic seat cushion assembly that is self inflating by means of a pumping chamber. In an embodiment described below, the pneumatic self inflating system has bolsters and cushion bladders containing foam. The assembly may also include a cushion bladder without foam on a bottom portion of the seat. The assembly may also include a back cushion with or without foam and back bolsters with or without foam. The assembly and system also include a pumping chamber, which is a separate bladder preferably located on the seat bottom and adjacent to or within the seat bottom cushion bladder. The pumping chamber is a bladder connected to the cushion bladder(s) and bolsters via outlet tubes. The pumping chamber has an air intake with a check valve. The pumping chamber outlet tubes to the other cushioning bladders may be fitted with a second check valve. The pumping chamber and cushion bladder system will also have a pressure release valve with an optional adjustable control through which the degree of pressure in the system may be selected by a user. In an embodiment designed for a folding jump seat, a final valve is included in the system for dumping air so that the entire assembly may be compressed for a stowed position.

In operation, the jump seat is opened by a user. Resilient foam in the cushion bladders and bolsters expands the bladders and bolsters to a first degree of rigidity, corresponding to a first pressure. The seat occupant takes the seat, and his or her weight will compress the cushions and bolsters thereby reducing the cushioning effect of them. Thereafter, movement of the seat occupant, either through vehicle motion or deliberate movement, will vary the pressure within the pumping chamber, causing it to take in air through the air intake. Escape of this air is checked by stop valve in the intake. Further movement of the seat occupant will cause air already in the pumping chamber to be exhausted from it. The system is designed so that this exhausted air is directed by outlet hoses to the cushion bladders and bolsters, to allow pressure within them to increase, thereby increasing rigidity and a passenger cushioning effect. In one embodiment, the seat occupant may use pressure release valves to select a degree of pressure and rigidity the user finds comfortable.

When the user is through using the seat and gets off of it, the seat can be folded back into its stowed position. Pressure from the pumping chamber, cushion and bolster bladders will be relieved through a dump valve.

Further features and advantages of the present invention, as well as the structure and operation of various embodiments of the present invention, are described in detail below with reference to the accompanying drawings.

BRIEF DESCRIPTION OF THE DRAWINGS

The preferred embodiment of the invention will now be described by way of reference to the drawings, where.

DETAILED DESCRIPTION OF THE PREFERRED EMBODIMENTS

Pressure Relief Valve Assembly

Figure 1:
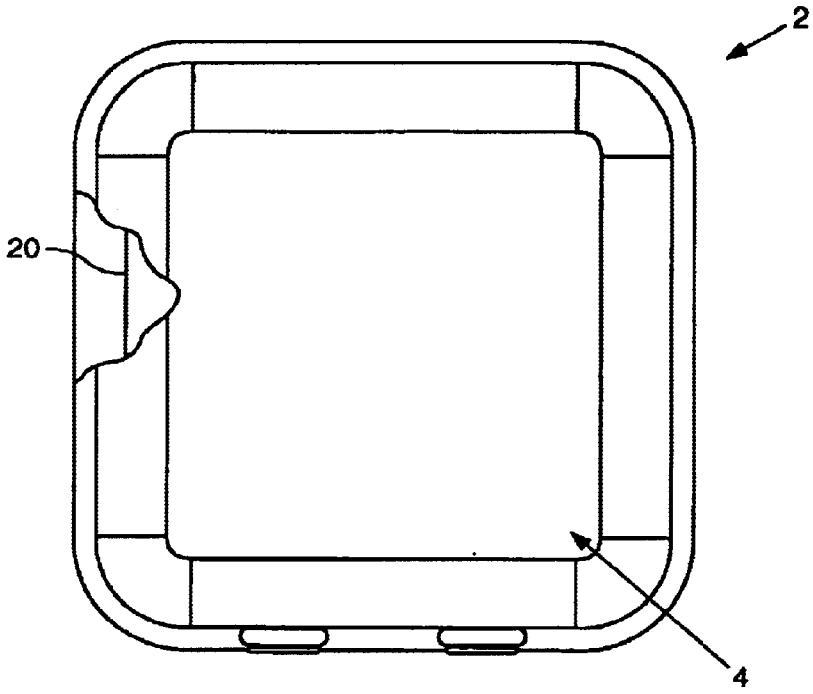
FIG. 1 is an upper plan view of a cushion assembly.
Figure 2:
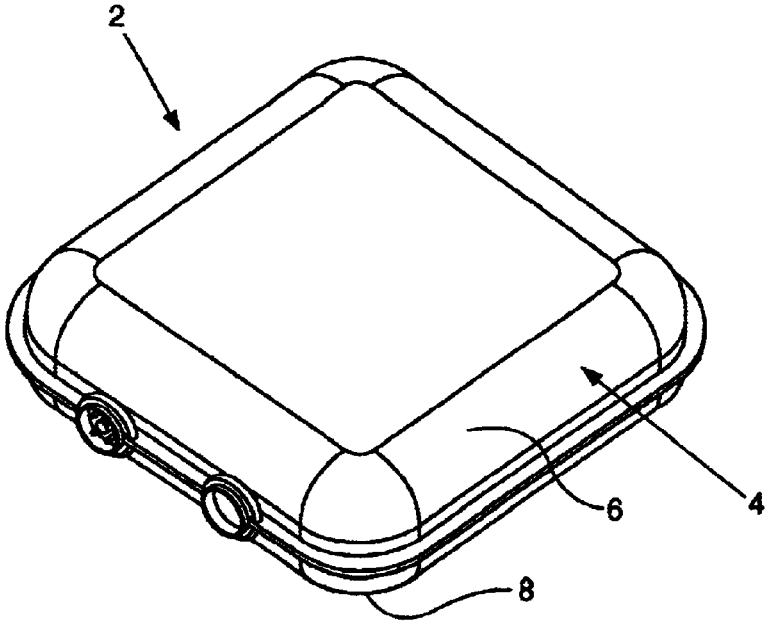
FIG. 2 is a three dimensional view of a cushion.
Figure 3:
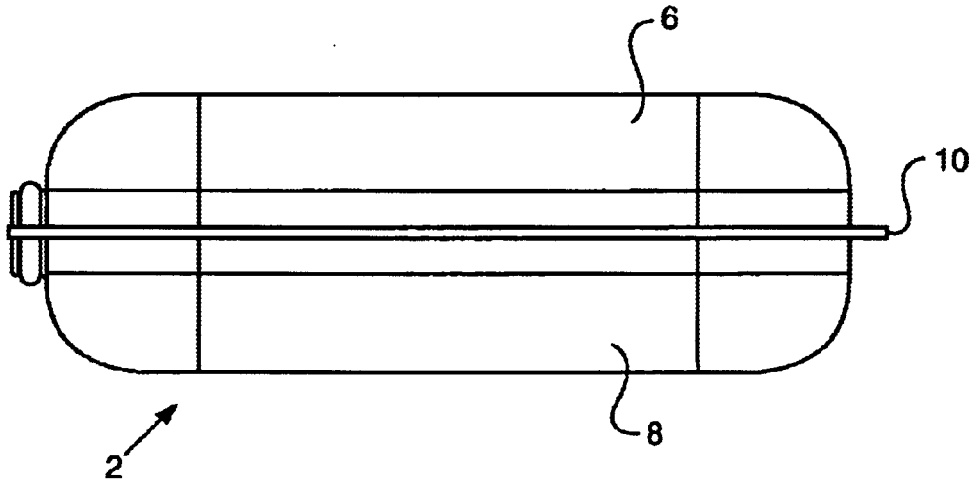
FIG. 3 is a side plan view of a cushion.
Figure 4:
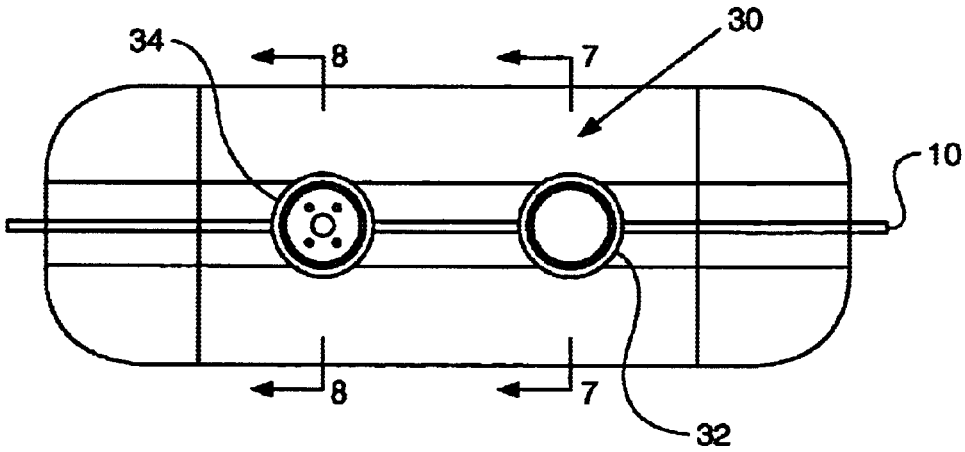
FIG. 4 is a front plan view of an assembly as shown in FIG. 1.

As best shown in FIGS. 1 and 2, the cushion assembly of the depicted embodiment is shown generally at 2 and includes an outer airtight bladder 4 comprised of upper and lower sections, shown generally at 6 and 8, which could be identical, formed in the clam shell style by attachment to each other around a peripheral seam 10. The adherence between the upper and lower halves 6 and 8 is made in a manner known to those skilled in the art, for example, by adhesive bonding, ultrasonic welding or the like. Internal to the bladder is a filler member 20 which is preferably a foam material having a resilient nature with a plurality of air pockets which can be pliably compressed. The preferred embodiment of the invention further includes a valve assembly shown generally at 30 which is comprised of two separate valve assemblies 32 and 34. Valve assembly 32 operates as a pressure relief valve, whereas valve assembly 34 operates as an automatic re-inflation valve, as to be described herein.

It should be appreciated that the assembly of the air tight cushion would include a relatively uncomplicated manufacturing process, including the cutting and trimming of the bladder material, that is the upper and lower members 6 and 8, by then placing the resilient filler member 20 within one of the bladder members 6 or 8, placing the valve assemblies 32 and 34 adjacent to the peripheral edge formed by the upper and lower members 6 and 8, and by adhering the peripheral seam 10 therearound to bond the upper and lower members 6 and 8 together. In order to accomplish the structure of the present invention, the bladder is preferably of a urethane material, but could also be a nylon/urethane laminate to increase the strength of the material. Furthermore, in the preferred embodiment of the invention, to accomplish the correct seating comfort, as well as reinflation of the cushion, the foam density of the resilient filler 20 is comprised of a foam with a density rating of 110/1 8ILD.

Figure 5:
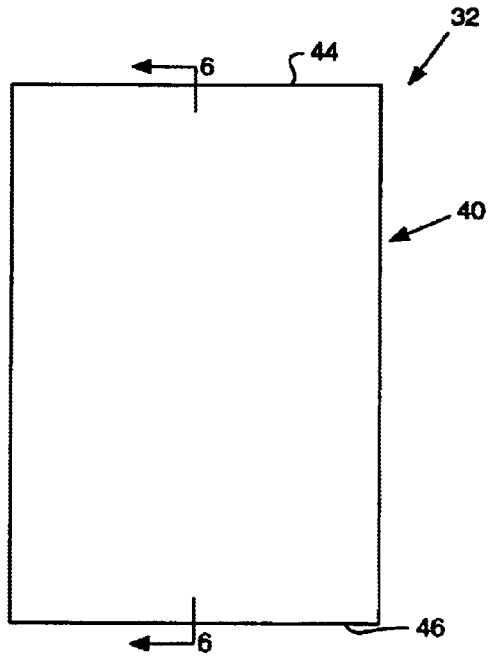
FIG. 5 is a side view of a valve assembly which may be used in the cushion system of the present invention.
Figure 6:
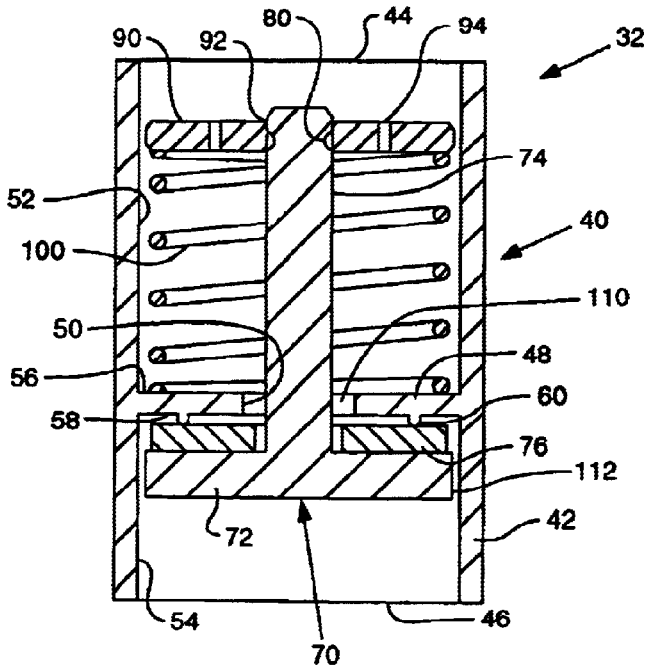
FIG. 6 is a cross sectional view taken through lines 6—6 of FIG. 5.

With reference now to FIGS. 5 and 6, the valve assemblies 32 and 34 will be described in greater detail. It should be appreciated that the valve principle structure used for the valve assemblies 32 and 34 can be almost identical in design, but have slightly different settings to accomplish either the pressure relief or automatic reinflate mode, as desired, and described herein. Therefore with reference to FIGS. 5 and 6, only one such valve assembly 32 will be described in detail, but will be referred to in FIG. 8 with a prime number.

As shown in FIGS. 5 and 6, the valve assembly 32 is comprised of an outer valve housing 40 having a cylindrical wall section 42 having end faces 44 and 46. An internal annular wall 48 is included, having an opening 50 therethrough which connects chambers 52 and 54 together. The internal wall 48 defines a spring bearing surface 56 on the one side thereof, and a valve seat surface 58 on the other side thereof, the valve seat surface 58 including at least one set of annular sealing ribs at 60.

The valve assembly 32 is further comprised of the moveable valve portion 70 including an annular ring 72, moveable within the chamber 54, the annular ring 72 being combined with a valve stem member 74 which passes through the opening 50 into the chamber 52. The moveable valve member 70 further includes a sealing diaphragm 76 which is received over the valve stem 74 and is positioned against the annular valve ring portion 72. The valve stem portion 74 includes at its outer end, a groove 80 which receives a flow control plate 90 in a snap fit, the flow control plate having a central aperture 92 having a rib which snap fits within the groove 80. The flow control plate '90 further includes a plurality of apertures at 94 for controlling the volume of the air passing into the chamber 52. Finally, a spring member 100 is inserted within chamber 52 and is positioned between the surface 56 and the inner side of the flow control plate 90. It should be appreciated from viewing FIG. 6, that the valve assembly 32 as constructed in the closed position, that is, that there is no air flow between passages 52 and 54, due to the diaphragm member 76 being spring loaded against the sealing ribs 60. It should also be understood that a force against the valve stem member 74 or against the flow control plate 90, would cause a compression of the spring 100 and would allow air flow through an opening 110, that is the annular area between the valve stem 74 and opening 50; and through opening 112, which is the annular area between the moveable valve member 72 and peripheral wall forming the chamber 54. With the reference now to FIG. 7, the operation of the cushion 2 will be described in the pressure relief mode.

Figure 7:
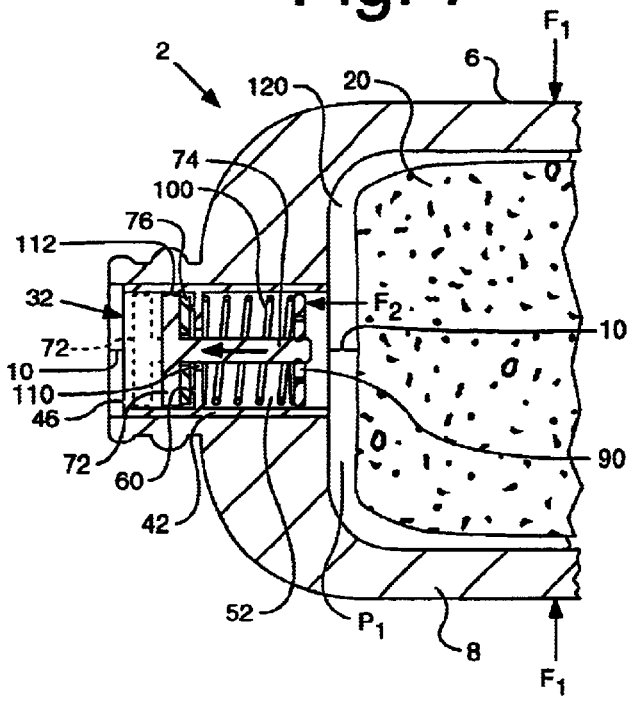
FIG. 7 is a cross sectional view taken through lines 7—7 showing the valve assembly in the pressure relief mode.

As shown in FIG. 7, when in use, a force $F_1$ is exerted on the cushion against the outer bladder 4 which causes an internal air pressure $P_1$ within an internal volume area 120, internal to the bladder 4. The internal pressure $P_1$ in turn, causes a force $F_2$ against the flow control plate 90 which attempts to compress the spring number 100. If the internal pressure $P_1$ is high enough, such that $F_2$ overcomes the spring pressure to move the diaphragm 76 off of the sealing ribs 60, pressure relief valve assembly 32 will open, exhausting air through passageways 110 and 112, to the atmosphere. As mentioned above, the cushion comfort is relative to the internal air pressure, and therefore, in the preferred embodiment of the invention, the air pressure is regulated by the pressure relief valve assembly 32 to be greater than atmospheric pressure, but less than 0.5 psig. Thus, when the internal pressure $P_1$ reaches the prescribed pressure for the pressure relief valve, the compression spring 100 will take over and once again move the diaphragm 76 into sealing engagement, holding internal pressure $P_1$ at the prescribed pressure.

Figure 8:
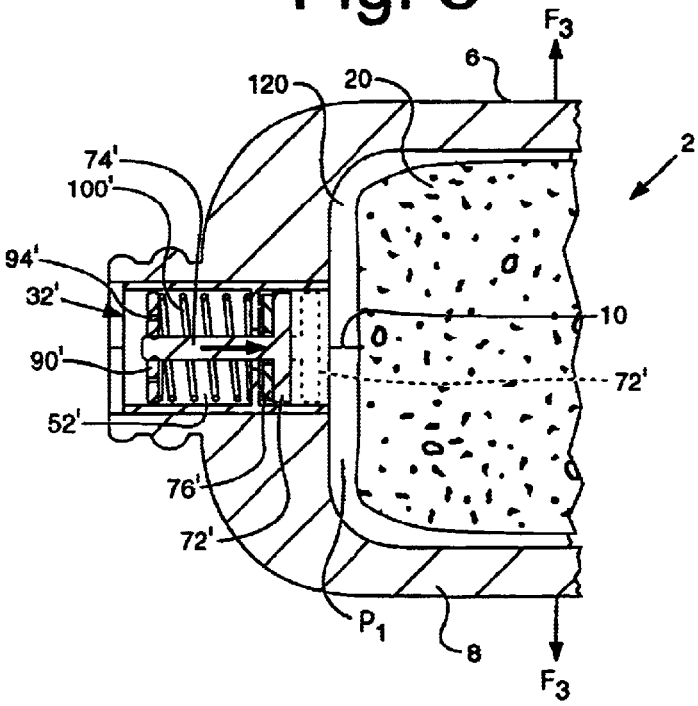
FIG. 8 is a cross sectional view through lines 8—8 of FIG. 4 showing the valve assembly in the automatic reinflate mode.

With reference now to FIG. 8, the valve assembly 32 will be described in the automatic reinflate mode. As mentioned above, while all the components of the valve assembly 32 are of a similar nature, the settings could be different for its operation and therefore, the re-inflation valve will be described with a prime number. As shown in FIG. 8, the cushion 2 is shown where no external force on the bladder members 6 and 8 is being exerted. In this scenario, an internal resilient force $F_3$ is, caused against the inside of bladder members 6 and 8 by the foam resiliency. In this case, the resiliency of the foam 20 not only causes an outward force $F_3$ against the bladder walls 6 and 8, it also causes the foam cells to expand, thereby increasing the volumetric size of individual cells that were once previously compressed, and with the increased volume, causes a vacuum pressure. Thus, pressure $P_1$ after the force $F_1$ is released, is less than atmospheric pressure or would be a negative gauge pressure.

It should be appreciated that valve assembly 32' is now positioned in its respective opening in the reverse sense, that is, reverse to the FIG. 7 configuration, such that the vacuum pressure $P_1$ causes the diaphragm member 76' to move inwardly towards the internal cavity 120. thereby causing air to flow back into the bladder, to reinflate the cushion to its normal state. However, due to the apertures 94' in a flow control plate 90', the reinflation is a time released function, so that the simple act of moving around or readjustment of a position by the user does not cause total reinflation of the cushion. It should be appreciated that the settings for both valves 32 and 32' may well depend on the application in which the cushion is used.

The pressure relief valve portion would operate when the passenger is seated with his or her back against the back pad, and when the pressure reaches the threshold pressure of the pressure relief valve 32, the valve would exhaust the air, to the prescribed internal set pressure. The flow control plate 90, and in particularly the number and sizing of the apertures would prevent complete depletion of the air internal to the bladder, during spikes of pressure. Rather, what is intended by the pressure relief valve 32, is for a slow release of air, and the pressure internal to the bladder such that there is a time release function so that the bladder reaches a steady state pressure to the prescribed pressure over time, not instantaneously.

In the same manner, the auto reinflate valve 32, and its associated air flow plate 90' are designed so that the seat cushion may be prevented from auto reinflating with every movement by the user. The flow control plate 90' will operate in this mode to prevent a re-inflation of the bladder, such that the user need not reposition the seat back to the comfortable position. Also it is not intended for the seat back to totally reinflate, when the user passenger gets out of the seat, but rather, to have a slow timely reinflation.

It should be appreciated then that many advantages are offered by the above invention. namely that the cushion could be used in a variety of applications with both a set prescribed internal pressure designed for maximum comfort, as well as having an auto reinflate cushion when pressure is released therefrom. The seating can be automatically adjusted to the users comfort. It should also be appreciated that seats may also auto reinflate.

Pumping Chamber Self Inflating Assembly

Figure 9:
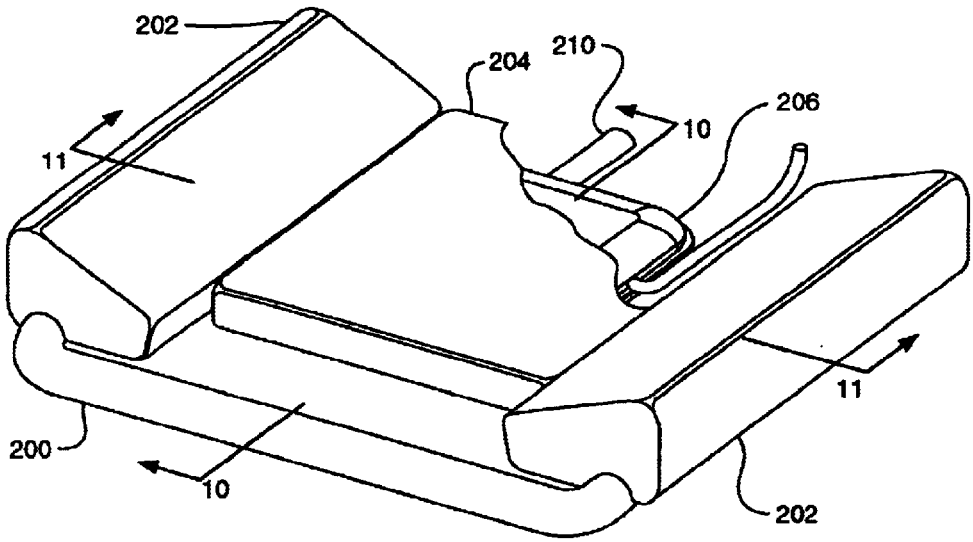
FIG. 9 is a perspective view of the self inflatable cushion assembly of the present invention.

Referring now to FIG. 9, the self inflating pneumatic cushion assembly is depicted installed on a seat frame, 200. Side bolsters 202 are mounted on the seat frame 200 and the cushion bladder 204 is suspended from frame 200 according to known techniques. Pumping chamber 206 is adjacent to, or, alternatively, within cushion bladder 204. Not depicted are similar and analogous pneumatic bladders forming cushions and bolsters for a seat back.

In the depicted embodiment, bolsters 202 and cushion 204 are filled with a resilient foam material that compresses so that the cushions may be closed to a compact volume, as for example upon the stowing of a jump seat. Of course the foam also expands when released, filling the bladders in which they are disposed to a first degree of pressure and rigidity.

Alternatively, the pneumatic bladders comprising bolsters 202, cushion 204 and pumping chamber 206 may be open and without foam inside them. Another alternative is that the foam have interposed within it air chambers. The pumping chamber cushion, sometimes known as a "lung bladder," may or may not have foam in it as well.

Figure 10:
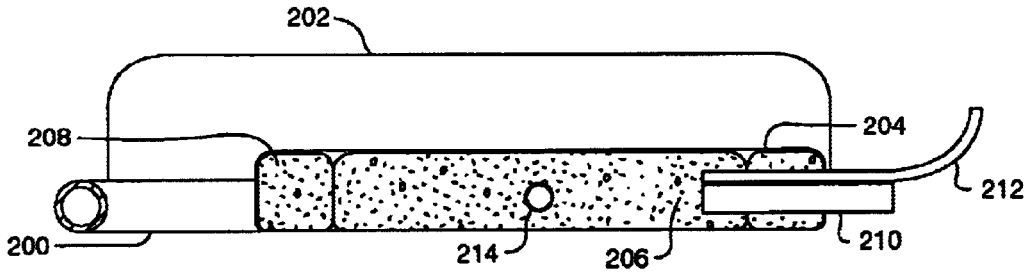
FIG. 10 is a cutaway side view of the self inflatable cushion assembly of the present invention.
Figure 11:
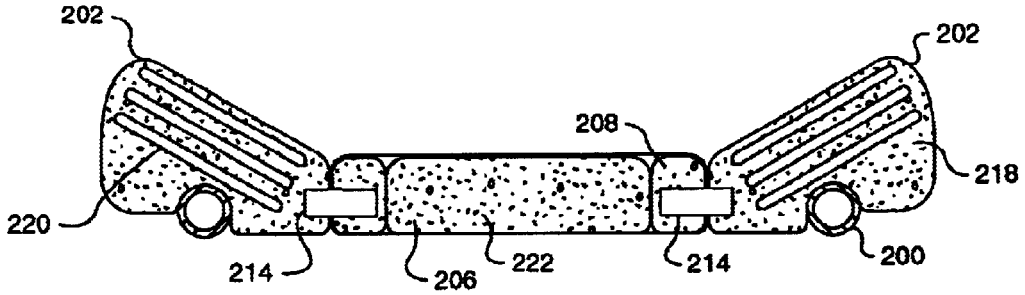
FIG. 11 is a cutaway front view of the inflatable cushion assembly of the present invention.

Referring now to side view FIG. 10 and front view FIG. 11, both being cut away views, pumping chamber 206 is disposed adjacent to or within cushion bladder 204. Both are suspended from frame 200 according to known techniques. Alternatively, pumping chamber 206, when disposed within cushion bladder 204 may be surrounded by or partially abutted by cushion foam 208. At least one air inlet 210, is attached to pumping chamber 206 so that it may intake new and additional volumes of air for inflating the other cushions and bolsters. According to the apparatus, system and method of the present invention, the pumping chamber 206 is connected with the cushions and bladders of the seat with outlet tubes 212, 214. The depicted outlet tube 212 is directed towards a seat back bladder (not shown).

Figure 12:
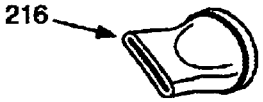
FIG. 12 is a close up of the dump valve.

Also depicted in FIG. 10 are bottom outlet tubes 214 connecting the pumping chamber with the side bolsters. FIG. 10 also depicts the location of a check valve, for example a "duck bill" check valve for "dumping" all of the air from the system when a jump seat is to be stowed and all of the bladders compressed. An example of a check valve 216 is shown in FIG. 12.

Cut away front view FIG. 11 depicts the encapsulated resilient foam 218 contained within side bolsters 202. The resilient foam may in turn contain air pockets 220. Pumping chamber 206 may also contain foam 222. Outlet tubes 214 connecting the pumping chamber 206 to the bolsters 202 are depicted.

Not shown in FIGS. 9–12 are a system of valves. Air inlet 210 has a check valve preventing escape of air through it. Outlet tubes 212 and 214 may or may not have check valves, either alternative being within the scope of the present invention. Dump valve 216 may have, as an alternative within the scope of the present invention, an adjustable valve with which a user may control the overall rigidity of the bladder cushion system. The valve may be according to the valve described above. With or without an adjustable control valve, the dump valve 216 will be configured to open upon closing of a jump seat embodiment of the present invention.

In operation, in a jump seat embodiment of the present invention, the jump seat is at first stowed flat with the frame 200 being folded upwards and against a seat back frame (not shown). A user then opens the jump seat, lowering frame 200 to its position for use. Thereupon foam 218 and 222 expands allowing air to be taken in through the intake 210 and to the bladders 202, 204 and 206 and the seat back bladders (not shown) to inflate to a first pressure. Thereupon the seat occupant takes his seat and compresses all the bladders and the foam within them to a second pressure. Thereafter the seat occupant will move. This may be known, voluntary movement, or it may be passive movement caused by driving of the vehicle in which the jump seat is installed. In either case movement of the seat occupant will cause the pumping chamber 206 to cycle through stages of greater and lesser pressure. At a period of lesser pressure or greater expansion of the bladder, air will be taken in through air inlet 210. The air is prevented from releasing back out of air inlet 210 through a check valve (not shown). On the next compression cycle of pumping chamber 206 the air just taken in will be distributed through outlet tubes 212 and 214 to the bolsters 202, and cushion bladder 204 and seat back bladders and bolsters (not shown). This cycle will continue until such time as an equilibrium pressure is reached whereby the seat occupant is afforded a greater degree of support than had been available to him or her upon the first pressure obtained by the simple expansion of the foam inside the bladders.

As an alternative within the scope of the present invention, the user may selectively control the final pressure of the bladder system with an alternatively installed control valve. The control valve may be a separate escape valve (not shown) from the dump valve or may be incorporated into the dump valve. By use of a selective valve allowing pressure to be relieved at a certain user selected level, the user may control the degree of pressure and rigidity in the bladder system. The control valve or pressure release may be of a type known in the art, of the type described hereinabove, or a hitherto unknown type.

When the occupant leaves the seat, if the seat is to be stowed, lower frame 200 is folded into its stowed position. A linkage according to known technologies, as for example a cam or lever, operates to open the dump valve upon movement of the frame 200 to its closed position, thereby allowing the complete release of air from all the bladders and bolsters so that the foam within them may be compressed and the jump seat embodiment of the present invention compressed into its stowed position.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, Thus, the breadth and scope of the present invention should not be limited by any of the above-described exemplary embodiments, but should be defined only in accordance with the following claims appended hereto and their equivalents.

What is claimed is:

1. A self inflating pneumatic seat cushion apparatus comprising:

a pumping chamber having an air inlet and at least one outlet tube, said pumping chamber being filled with resilient foam;

at least one cushion bladder in operative communication with said pumping chamber via said at least one outlet tube, said at least one cushion bladder being filled with resilient foam and said at least one cushion bladder having an exhaust valve, said exhaust valve having an adjustable pressure release whereby a user may selectively control pressure in said pumping chamber and said at least one cushion bladder; and wherein the self-inflating pneumatic seat cushion apparatus is installed in a folding seat.

2. The apparatus of claim 1 further comprising a check valve in said at least one outlet tube.

3. The apparatus of claim 2 wherein said check valve is time controlled.

4. The apparatus of claim 3 wherein said time control of said check valve is controlled by at least one perforation in a flow control plate.

5. The apparatus of claim 2 wherein said check valve is preconfigured to open at a pressure that is greater than atmospheric pressure.

6. The apparatus of claim 2 wherein said check valve is preconfigured to close at a pressure of about 0.5 PSIG.

7. The apparatus of claim 1 further comprising a check valve in said air inlet.

8. The apparatus of claim 7 wherein said check valve is time controlled.

9. The apparatus of claim 8 wherein said check valve is time controlled by at least one perforation in a flow control plate.

10. The apparatus of claim 7 wherein said check valve is preconfigured to open at a pressure greater than atmospheric pressure.

11. The apparatus of claim 7 wherein said check valve is preconfigured to close at a pressure substantially about 0.5 PSIG.

12. The apparatus of claim 1 wherein said at least one cushion bladder has a dump valve.

13. The apparatus of claim 12 wherein said dump valve is adjustable and wherein said dump valve has an adjuster accessible by a user for controlling the overall rigidity of the cushion bladder system.

14. The apparatus of claim 1 wherein said at least one cushion bladder is on a seat bottom.

15. The apparatus of claim 1 further comprising at least one bolster.

16. The apparatus of claim 15 wherein said at least one bolster contains foam.

17. The apparatus of claim 1 wherein said pumping chamber is adjacent to said at least one cushion bladder.

18. The apparatus of claim 1 wherein said pumping chamber is at least partially within said at least one cushion bladder.

19. The apparatus of claim 1 wherein at least one of said at least one cushion bladder or said pumping chamber is made from a material selected from the group consisting of: urethane and a nylon/urethane blend.

20. The apparatus of claim 1 wherein at least one of said foam in said pumping chamber or said foam in said at least one cushion bladder has a density of substantially about 110/1 8ILD.

21. The apparatus of claim 1 wherein said foam in at least one of said pumping chamber or said at least one cushion bladder has air chambers.

22. A method of assembling an inflatable seat cushion system for a folding seat comprising:

connecting a pumping chamber with a cushion bladder such that air may flow from said pumping chamber into said cushion bladder;

allowing air flow into said pumping chamber via an inlet, said inlet having a check valve;

operatively connecting a dump valve to said cushion bladder such that said cushion bladder may be deflated to a volume allowing storage of said system;

sealing within at least one of said pumping chamber or said cushion bladder a volume of foam sufficient to expand said pumping chamber or said cushion bladder upon opening of the folding seat; and disposing said pumping chamber such that movement of an occupant of the seat having said system installed therein causes airflow into said pumping chamber and airflow out from said pumping chamber to said cushion bladder; and mounting said pumping chamber and said cushion bladder within the folding seat.

23. The method of claim 22 further comprising:

fitting said dump valve with an adjuster such that a user can selectively control a pressure level within said cushion system.

24. A self inflating pneumatic seat cushion apparatus comprising:

a pumping chamber having an air inlet and at least one outlet tube, said pumping chamber being filled with resilient foam;

at least one cushion bladder in operative communication with said pumping chamber via said at least one outlet tube, said at least one cushion bladder being filled with resilient foam and said at least one cushion bladder having an exhaust valve, said exhaust valve having an adjustable pressure release whereby a user may selectively control pressure in said pumping chamber and said at least one cushion bladder; and a time controlled check valve in said at least one outlet tube.

25. The apparatus of claim 24 wherein said time control of said check valve is controlled by at least one perforation in a flow control plate.

* * * * *